United States Patent [19]

Bruce

[11] 4,455,353

[45] Jun. 19, 1984

[54] METHOD OF PRODUCING AN ARTICLE AND ARTICLE PRODUCED IN A MOULD WHICH DEFINES THE CONTOUR OF THE ARTICLE

[75] Inventor: Lars M. Bruce, Viken, Sweden

[73] Assignee: Uddeholms Aktiebolag, Hagfors, Sweden

[21] Appl. No.: 306,917

[22] PCT Filed: Dec. 29, 1980

[86] PCT No.: PCT/SE80/00350

§ 371 Date: Sep. 28, 1981

§ 102(e) Date: Sep. 28, 1981

[87] PCT Pub. No.: WO81/02126

PCT Pub. Date: Aug. 6, 1981

[30] Foreign Application Priority Data

Feb. 1, 1980 [SE] Sweden ..... 8000799
Sep. 19, 1980 [SE] Sweden ..... 8006580

[51] Int. Cl.[3] ..... B22F 3/00; B22F 3/26

[52] U.S. Cl. ..... 428/553; 428/554; 428/567; 419/8; 419/27; 419/25; 419/47

[58] Field of Search ..... 75/200, 208 R, 227; 428/553, 554, 567; 419/27, 8, 47, 25

[56] References Cited

U.S. PATENT DOCUMENTS 2,942,970 6/1960 Goetzel et al. ..... 75/200
3,262,190 7/1966 Rostoker et al. ..... 75/208 R
3,773,506 11/1973 Larker et al. ..... 75/208 R
3,915,699 10/1975 Umehara et al. ..... 75/214

FOREIGN PATENT DOCUMENTS 476405 8/1951 Canada ..... 428/568

*Primary Examiner*—Brooks H. Hunt
*Attorney, Agent, or Firm*—Murray, Whisenhunt & Ferguson

[57] ABSTRACT

Article produced in a mould for a plastics moulding tool having a mould surface defining the contours of the article, with the article comprising a body formed from a composition comprising a sinterable material having a sintering temperature which material, before sintering, is shapable into a desired shape and which during sintering forms a porous body having pores, the sinterable material being at least partially sintered in the mould, and also comprising a matrix having a lower melting point than the sintering temperature of the sinterable material, with the matrix comprising a matrix metal which is infiltrated in the porous body to substantially fill the pores. The article also comprises at least one metal tube having an outside surface and being disposed in the body to provide one or more cooling passages in the body, with the metal tube comprising a metal having a melting point which is higher than the sintering temperature of the sinterable material, with a portion of the external surface of the tube being partially removed by being dissolved in the matrix metal prior to soldification of the matrix metal to bond the matrix and the tube together. The sinterable material is dissolvable in the matrix metal in its molten state and this limits dissolution of the metal of the tube in the matrix so that the metal of the tube is only partially removed in an amount which is insignificant to effect operation of the tube. Also provided is a method for producing the article, in which the mould is filled with powder or grains of the sinterable material and the tube is embedded in this. Cooling passages may also be provided in the material of the mold in which the article is produced.

26 Claims, 3 Drawing Figures

METHOD OF PRODUCING AN ARTICLE AND ARTICLE PRODUCED IN A MOULD WHICH DEFINES THE CONTOUR OF THE ARTICLE

TECHNICAL FIELD

The present invention relates to a method of producing an article which consists mainly on the one hand of sinterable material which, before it is sintered, can be given a relatively easily shaped state and has the characteristic of forming a relatively porous body during sintering, such as metal powder, and on the other hand of a matrix consisting of a metal with a lower melting point than the sintering temperature for the sinterable material. The method comprises filling a mould with powder or grains or the sinterable material, said mould having a mould surface which defines the shape of the article, heating the contents of the mould to the sintering temperature of the sinterable material so that a powder body is obtained, melting a matrix metal and causing it to filtrate into the powder body, and thereafter causing the matrix metal to solidity.

The invention also relates to an article produced in a mould which defines the contours of the article, which article consists mainly of a composite material comprising on the one hand a porous body of a metal powder which is more or less firmly sintered together, and on the other hand a matrix which is obtained by infiltration of an infiltrand consisting of an alloy with a lower melting point than the sintering temperature for said metal powder, which matrix fills pores of the porous body. In particular, the invention relates to a mould in a moulding tool such as a plastics moulding tool, a diecasting tool etc., with satisfactory strength and polishing capacity.

BACKGROUND OF THE INVENTION

Moulds of the above-mentioned kind and a method for producing them are already known, for example through the Swedish published Patent Application No. 76 00895-2 (GB No. 1 541 446). This known invention has also begun to be used in practice for the production of moulds in plastics moulding tools and, within this field, has represented a considerable technical advance in comparison with moulds produced in a conventional manner, primarily because the production costs are lower but also because they can be produced much more quickly which in many cases is of decisive importance.

It is also known to dispose cooling passages in moulding tools with the object of causing the products which are to be moulded in the tool to solidify more quickly and/or to bring about a controlled solidifying process. Conventionally, these cooling passages are produced by drilling in the tool or the material of the tool. For natural reasons there are great limitations to this conventional technique. For example, it is not possible to drill curved cooling passages; only straight passages or passages composed of straight portions. Only exceptionally can the passages be placed so that they "cover" all the moulding surfaces of the tool or even considerable parts of these, from the cooling point of view. Another disadvantage of cooling passages which are produced in conventional manner by drilling is that their walls do not have any better resistance to corrosion than the resistance of the material of the tool to corrosion. This applies both to moulding tools produced conventionally and to moulding tools of the kind given in the definition of the technical field of the invention. During use of the tool, the cooling water can therefore corrode the cooling passages so that these become wholly or partially blocked. Admittedly, this can be counteracted in certain cases by means of corrosion inhibitors or by lining the cooling passages with a more corrosion-resistant material. There are great limitations to both these possibilities, however, and in all circumstances they involve complications which are such serious complications when it is a question of lining, that this method is scarcely realistic in practice.

A specific complication in producing the composite article given in the technical field of the invention results from the tendency of the matrix metal to shrink in connection with the solidification. Normally, the solidification does not take place simultaneously in all parts of the porous body but first in the parts where the cooling is greatest, the shape and structure of the body being stabilized in these parts. Through the shrinkage, matrix metal which has not solidified can be sucked away to a certain extent from other parts of the porous body, inter alia from surface portions which have not yet been stabilized. As a result, the sintered material projects in relief in these surfaces so that the surfaces are rough. In certain cases, this may be fatal, particularly if these surfaces are to constitute moulding surfaces in a moulding tool with high requirements regarding accuracy of dimensions and fineness of surface. In the majority of cases, the problem can admittedly be solved by finishing in the form of grinding and/or surface coating, but it is desirable not to have recourse to this, if possible.

DISCLOSURE OF INVENTION

The object of the invention is to eliminate the above-mentioned limitations and disadvantages in the method and the article according to the invention. More specifically, it is an object to dispose passages in the article and/or in the material of the mould in which the article is produced so that, during production of the article, surfaces can be produced which do not require any or only the minimum after-treatment.

It is also an object to provide an article, particularly a mould intended to be included in a moulding tool, with cooling passages with very satisfactory corrosion resistance to the usual coolants.

A further object is to provide an article with cooling passages and a method of production which can be used both during the use of the article, for example, in the moulding tool and during the production of the article.

Yet another object is to provide a simple method of controlling the stabilization of the article by controlled solidification of the matrix metal.

Yet another object is to provide a method which is simple to carry out and which does not require extensive investment in equipment.

These and other objects can be achieved in that at least one passage is placed at a short distance, that is to say at a slight depth from a surface of the article to which it is desired to give a particularly fine and controlled structure, such that the passage is caused to "cover" the whole of said surface or selected, important parts thereof, functionally from the cooling point of view. During the solidification of the matrix metal, a coolant is conveyed through the passage so that a more rapid freezing of the matrix is obtained in the region close to the passage than in more remote parts of the powder body, as a result of which the sucking in of matrix metal from the surface region into the more remote parts of the powder body as a result of shrinkage of the matrix in connection with its continued solidification is counteracted.

The passage or passages may consist of one or more tubes of a metal or alloy with a melting point which is higher than the sintering temperature of the sinterable material, wherein the tube(s) is/are disposed and located in the mould on inner side of the surface which it is desired to give a particularly fine and controlled structure, and wherein then the mould is filled with powder or grain of the sinterable material so that said tube is embedded in the sinterable material, and the matrix metal is melted and caused to filtrate into the powder body and to flow round said tube embedded in the powder body and to be metallically bonded to this.

As an alternative or in combination with the method tubes, one or more cooling passages may also be disposed in the material of the mould close to the moulding surface which is to give the article particularly fine and controlled structure. Also in this case the passage or passages is/are provided to "cover" the surface or selected, important parts thereof, functionally from a cooling point of view, such that a coolant which is conveyed through the said cooling passage/cooling passages disposed in the mould will cause the more rapid freezing of the matrix in the region near the cooling passage/cooling passages than in other parts of the powder body.

The passage/passages may "cover" the surface through spiral winding, by meander-like bending or by combinations of various winding or bending patterns, or by pronounced beadth extension in directions parallel to said surface. When the cooling medium is conveyed through the passage/passages it will effectively reach all parts of the "covered" parts of the surface, that is to say including also surface portions between adjacent turns or loops of the tube.

The article of the invention contains one or more passages consisting of metal tubes which are disposed in the powder body and have a melting point which is higher than the sintering temperature for the sinterable material and the outsides of which are metallically connected to the infiltrated matrix metal. Preferably, the metal in said tubes has a certain dissolving capacity in the matrix metal in its melted state so that the material in the tube/tubes is partially removed from said outside of said tube, though to a depth which is insignificant for the operation of the tube, and is dissolved in the matrix metal before this is caused to solidify, as a result of which matrix and tube material are bonded to one another.

Various selections of material for sintering material, matrix metal and tube are conceivable within the scope of the invention. The sintering material preferably consists of an iron-based powder, a hardenable steel powder being suitable. The matrix metal (alloys are included in the expression metal in this connection) can consist mainly of one ore more of the metals copper, tin, nickel, zinc, aluminium, niobium and beryllium. The matrix metal may appropriately consist mainly of copper with a certain content of tin and/or other metal which reduces the capacity of the copper to dissolve in iron in the molten phase. Finally, the tube or tubes, in the case they are provided in the powder body, preferably consist of a metal (here, too, the concept of metal includes alloys) with the same base as the sintering material, or of another material the solubility of which in the molten matrix metal is reduced by dissolving a certain amount of the sintering material in the matrix metal. The said tube material preferably consists of steel, stainless steel being suitable. Other tube material may, however, be considered if so desired in order to achieve special characteristics, for example nickel-based material.

According to a preferred embodiment of the method according to the invention, the powder body is sintered and the matrix metal is melted and is caused to infilter into the powder body in a heated furnace or the like at a temperature between 1,000° and 1,250° C., preferably at a temperature between 1,000° and 1,200° C., preferably under vacuum or in an atmosphere of inert gas. After the matrix metal has been infiltrated into the powder body and been caused to dissolve partially in the sintered material and the tube material, a coolant, preferably air or another gas, is conveyed through said tube until the matrix metal has solidified at least in the regions of the powder body adjecent to the tube so that the powder body is stabilized within these regions. The coolant may appropriately be introduced through connections which extend out of the furnace chamber or corresponding chamber where the powder body is kept during at least a part of the solidifying process, until the temperature in the furnace chamber or the like has dropped to below the solidifying temperature of the matrix metal, preferably to below 800° C. and appropriately to below 700° C., after which the rest of the matrix is caused to solidify, preferably by forced cooling of the whole mould with its contents. As an alternative or complement to keeping the mould with its contents in the furnace chamber or the like, it is also conceivable to keep the mould isolated from external cooling while the coolant is being conveyed through said tube.

A powder which is produced by gas granulation of a metal melt may appropriately be used as metal powder. The powder should not contain grains with a size exceeding about 200 μm and the proportion of fine powder with grain sizes below about 45 μm should be at most about five percent by weight. After being loaded into the mould, the metal powder should be impact-compacted and/or vibrated until its has a satisfactory degree of tight packing. The amount of infiltrand can vary depending on the selection of infiltrand and metal powder but in the normal case amounts to about 55–60 percent by weight of the amount of powder.

Further characteristics and aspects of the invention are apparent from the following claims and from the following description of preferred forms of embodiment.

BRIEF DESCRIPTION OF DRAWINGS

In the following description of preferred forms of embodiment reference is made to the accompanying figures of the drawings of which

In the Figures, only those details have been shown which are of importance for an understanding of the invention while other details have been omitted so that what is important may stand out better. In FIG. 1, for example, the runners, guide pins and guide bushings as well as the lifting aids have been omitted, that is to say details which can be applied in conventional manner as a concluding finishing operation, and in FIG. 2 and FIG. 3, the production is only shown diagrammatically to illustrate its principles.

DETAILED DESCRIPTION OF THE INVENTION

Figure 1:
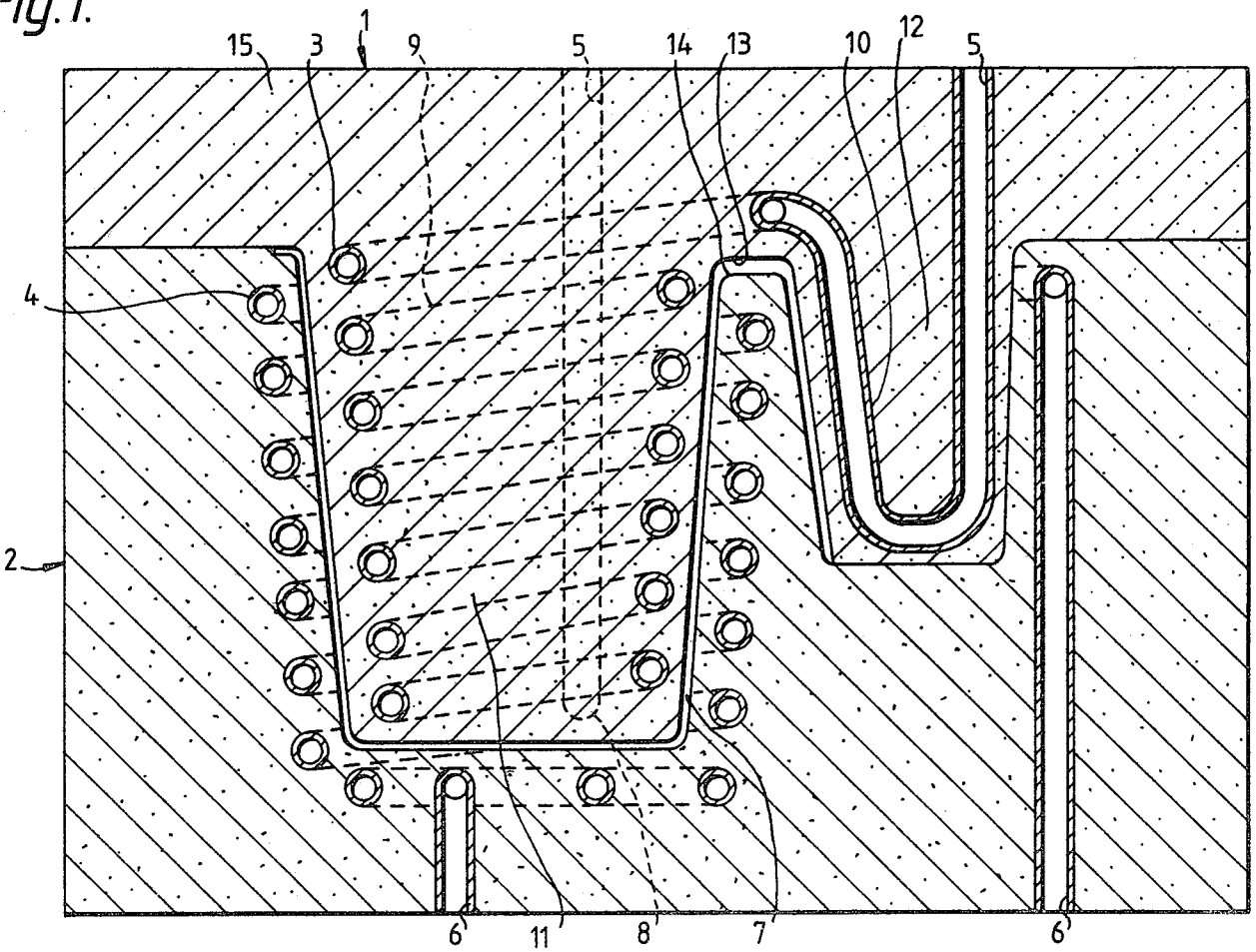
FIG. 1 shows a pair of articles according to the invention consisting of a male mould and female mould for a plastic moulding tool.

Referring first to FIG. 1, the male and female moulds for a plastics moulding tool for producing a pot have generally been designated 1 and 2 respectively. The mould cavity between the male and female moulds 1 and 2 is designated 7, while the mould surfaces which define the mould cavity are designated 13 and 14 respectively. According to the form of embodiment, the material in the moulds 1 and 2 consists of a hardenable steel powder containing carbon which is sintered into a powder body with the same shape as the moulds 1 and 2, after which a matrix is caused to infilter into the pores of the powder body by incorporation of an infiltrand in the powder body. According to the form embodiment, the matrix consists of a copper base alloy, preferably copper with a certain amount of tin and possibly further elements with the object of increasing the hardness of the matrix metal. The ratio by weight of matrix: steel powder amounts to about 35:65.

According to the invention, each of the moulds 1 and 2 also contains a cooling passage 3 and 4 respectively. These each consist of a tube 5 and 6 of stainless steel, the tubes extending as a coil through the moulds 1 and 2 respectively. Thus the tube 5 extends first straight down towards the bottom of the male mould portion 11 which is to form the main portion of the pot and there first describes loop 8 over the bottom to climb up afterwards in spiral form—9—along the walls of the "pot". Then the tube 5 is bent over the edge of the "pot" to extend down with a meandering coil 10 into the male mould portion 12 which is to form the handle on the pot, after which the tube again extends out of the mould 1. The tube 5, which may lack joints or consist of a plurality of sections previously welded together, soldered together or otherwise united, thus describes a complicated curve of spirals, bends and meander-shaped portions inside the mould 1. The tube 6 is disposed in a similar manner in the female mould 2. The outer diameter of the tubes 5, 6 is 10 mm and the thickness about 1 mm. The distance from the walls of the moulds 1 and 2, that is to say from the mould surfaces 13 and 14 respectively, as about 10 mm and the spacing between adjecent tube portions amounts to about 25 mm. As a result, the cooling action of the tubes 5 and 6 can effectively reach all parts of the mould surfaces 13 and 14 of the mould cavity 7.

Figure 2:
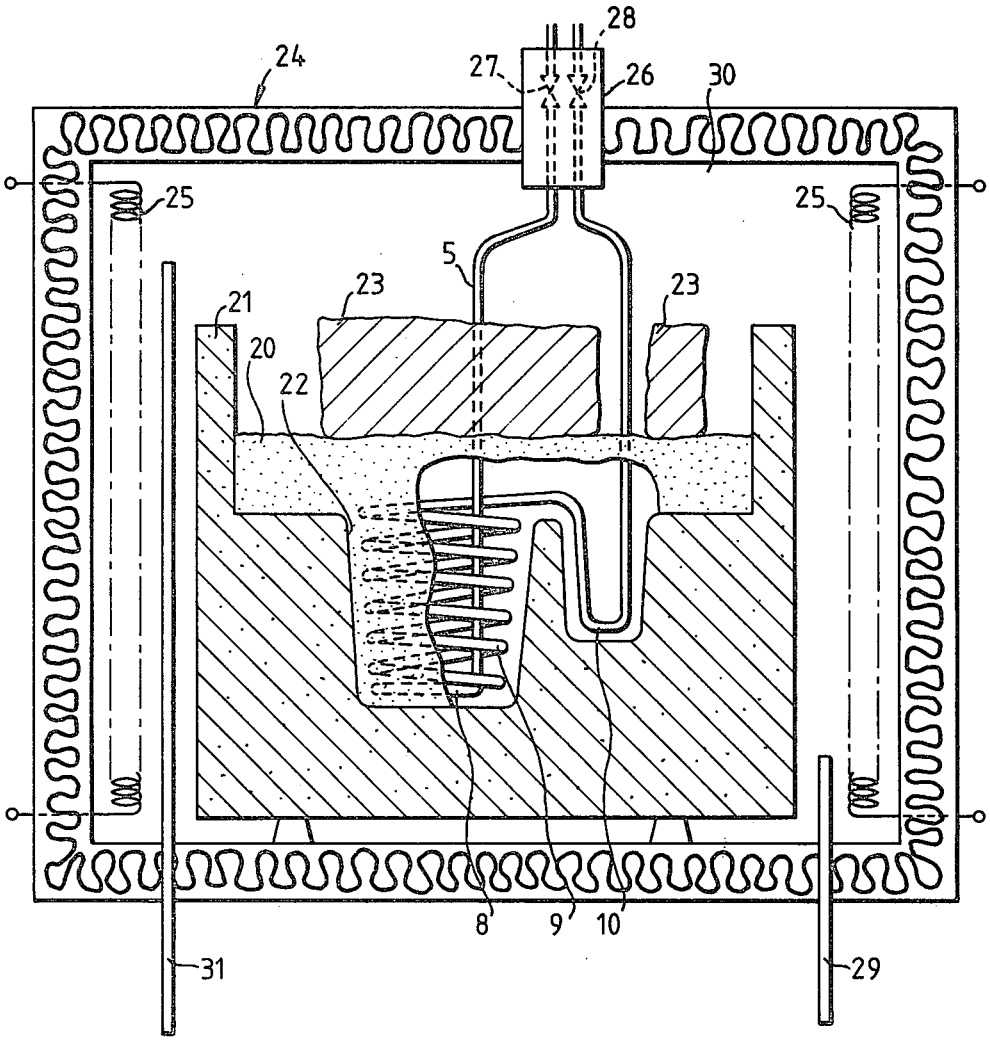
FIG. 2 illustrates the production of one part of the tool (the male mould) according to one embodiment of the invention.

Apart from the original infiltrand, the matrix also contains iron, carbon and possibly other elements which have dissolved in the matrix metal from the steel powder. Material from the outside of the steel tube has also been partially dissolved in the matrix. Through the dissolving of iron in the infiltrand primarily from the steel powder but partially also from the steel tube 5, 6, the matrix is saturated with regard to iron. In connection with this dissolving process, the surface of the steel tube 5, 6 has effectively been united to the matrix while at the same time the position of the tube is located in the stabilized powder body. Referring to FIG. 2, the same reference numerals as in FIG. 1 have been used for the five different parts of the tube. The previously bent—and possibly jointed tube 5—is arranged and provisionally located by means of a fixture in a ceramic mould 21 with a moulding surface 22 which determines the contours of the mould 1. The production of the mould 1, which does not constitute any part of this invention, can be carried out in a manner known per se, but can also be effected by unconventional methods. Then a volume of steel powder 20 corresponding to the mould 1 is introduced (together with powder for removal purposes in the back plate of the mould) and is impact-compacted and/or vibrated so that the bed of powder has a high degree of tight packing and so that the powder is packed tight against all the shaping surface 22 of the mould 21, which surfaces may have been provided with a mould release agent. Then an amount of infiltrand alloy corresponding to the amount of powder is placed in the mould in the form of one or more pieces 23 above the bed of powder 20. The mould 21 with its contents is then placed in a furnace 24, shown diagrammatically, with heating coils 25. The two ends of the tube 5 are taken out through the furnace through a bushing 26. A pair of valves are designated 27 and 28.

The air in the furnace 24 is evacuated and instead an inert gas is introduced, preferably argon, into the furnace chamber 30 through a pipe 29. During the continued process, the furnace chamber 30 is flushed with said inert gas which is introduced through the pipe 29 and conveyed out through an evacuation pipe 31. The furnace chamber 30 is heated electrically by the heating elements 25 to the sintering temperature of the steel powder, preferably to 1,150° C. and is held at this temperature by means of thermostats during the following sintering of the powder body 20 and melting of the infiltrand 23. The valves 27, 28 are kept closed during this phase. The powder body 20 is now sintered together to a more or less firm coherent skeleton. Afterwards the infiltrand 23 melts and runs down into the now sintered powder body 20 and fills in all its pores and even reaches all the moulding surfaces 22 of the mould 21 between the grains of powder. When all the infiltrand metal 23 has run down into the powder body 20, the temperature in the furnace chamber 30 is maintained at about 1150° C. for at least a further 30 minutes or more depending on the size of the product produced. Thus the infiltrand is kept in the molten state during all this time, and the steel powder 20 primarily but also the surface parts of the steel tube 5 are partially dissolved in the infiltrand so that this is saturated with regard to iron. As a result of the fine grain size (mainly 45–200 μm) of the steel powder and hence relatively large surface dissolving of iron from the steel powder is primarily responsible for the saturation of the infiltrand with regard to iron, as a result of which the steel tube 5 is prevented from being dissolved to an unacceptable extent before the matrix is saturated with iron and so further dissolution of the steel tube is prevented.

The supply of heat to the furnace chamber 30 is then disconnected. The valves 27, 28 are opened and cooling air is conveyed through the tube 5 until the temperature in the furnace chamber 30 has dropped to 700° C. As a result of the fact that air is conveyed through the tube 5, the matrix metal in the parts adjacent to the tube 5 are frozen initially, that is to say, inter alia the effective mould surfaces 13, FIG. 1, which together with corresponding mould surfaces on the female mould 2, FIG. 1, are to define the moulding cavity 7 in the infiltrand, complete tool. Afterwards, the matrix metal in the remaining parts of the powder body also solidifies. The shrinkage which now occurs results in molten matrix metal continuously being sucked in from other parts of the powder body but not from the initially solidified and therefore stabilized regions near the tube 5, that is to say not from the effective mould surfaces 13. These therefore have the required fine structure and surface fineness which the mould 21 can impart.

When the temperature in the furnace chamber has dropped to 700° C., all the mould surfaces are stabilized and the mould 21 with its contents can now be conveyed to a cooling chamber, not shown, where the continued cooling down can take place by forced cooling by means of fans. As a final operation, the mould 1 produced is removed from the mould 21, the ends of the tube are cut off and the back plate 15 of the tool, FIG. 1, is smoothed by milling or grinding.

Figure 3:
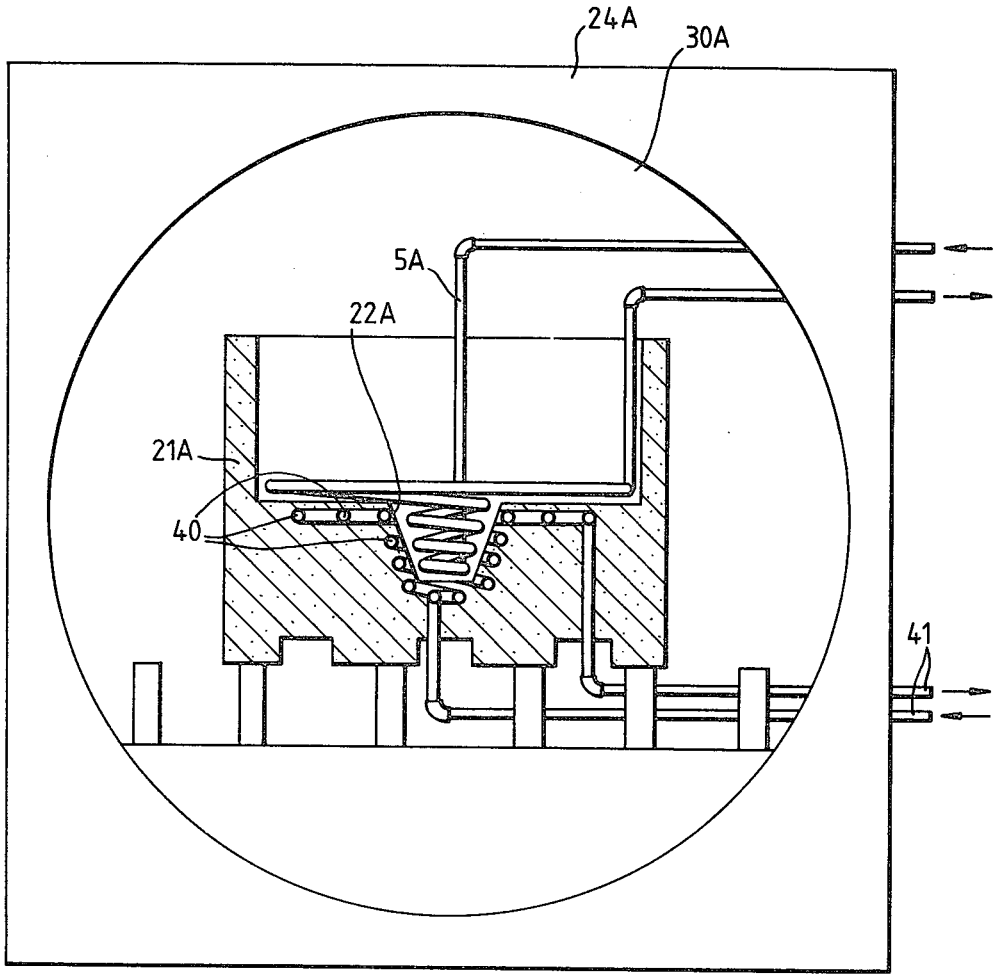
FIG. 3 illustrates a second embodiment of the method of the invention.

FIG. 3 illustrates the production, according to the invention, of the one part of the tool (a male mould) according to an alternative form of embodiment of the method according to the invention. In FIG. 3, a furnace shown diagrammatically is designated 24A and the furnace chamber is designated 30A. Disposed in the furnace chamber is a ceramic mould 21A with a moulding surface 22A which determines the shape of the desired product. A previously bent and jointed tube 5A is disposed in the mould 21A in the same manner as with the previus form of embodiment. It is presupposed that the tube 5A is disposed and located by means of a fixture in the mould 21A, but this fixture is not shown in the Figure. The mould 21A is then filled with a suitable amount of steel powder which is impact-compacted and/or vibrated, as described with reference to the previous form of embodiment. Furthermore, a corresponding amount of infiltrand alloy is placed on the amount of powder in the same manner as previously described.

What a novel in the form of embodiment according to FIG. 3 is comparison with the previous form of embodiment, consists in the fact that the mould 21A is also provided with a tube conduit. This is designated 40 and is provided with connections 41 which extend out through the wall of the furnace. The coiled tube 40 is disposed at a short distance from the moulding surface 22A and is embedded in the ceramic composition of which the mould 21A is made. The coiled tube 40 follows the shape of the moulding surface 22A in a similar member to the tube 4 in the female portion 2 in the previous form of embodiment.

The tube 40 may consist of various conceivable materials. The tube 40 preferably has a very low coefficient of expansion or the same coefficient of expansion as the ceramic composition in the mould 21A. A suitable material is a steel containing about 40% Ni and the rest substantially iron. Such material are known under the trade name INVAR. It is also possible to form cooling passages 40 as cavities in the mould 21A in conventional manner through one or more cores of wax or the like which is melted away when the ceramic mould is fired.

During the production of a product in the mould 21A the procedure is the same as in the previous example with the addition that coolant is also conveyed through the coiled tube 40 so as to freeze the matrix metal in the surfaces which lie close to the conduits 5A and 40, in the desired manner. For the evacuation of air and/or for the supply of protective gas, the furnace 24A is also provided with evacuation and gas supply pipes, not shown. Apart from this, regard to the method, reference should be made to the description previously given of the form of embodiment according to FIGS. 1 and 2.

In the illustrated embodiments the passages have been caused to cover the important surfaces by bending a tube to an adequate pattern. It is, however, also possible to achieve the same result as far as covering the surface from a cooling point of view by making the passage very broad in a direction parallel to said surface and correspondingly narrow in a direction perpendicular to the surface. This embodiment is particularly applicable for passages provided in the ceramic mould material.

I claim:

1. A method of producing an article comprising a sinterable material having a sintering temperature which, before sintering, is shapable into a desired shape and forms a porous body during sintering, and a matrix comprising a matrix metal of lower melting point than said sintering temperature of said sinterable material, said method comprising the steps of:

providing a mould having a mould surface defining the shape of said article;

providing at least one cooling passage a short distance from a surface of said article to be formed with a fine and controlled structure, said at least one cooling passage covering said surface or selected parts thereof for providing cooling to said surface or selected parts thereof;

filling said mould with powder or grains of said sinterable material;

heating said sinterable material to said sintering temperature to give a powder body;

melting said matrix metal to cause said matrix metal to filtrate into said powder body;

permitting said matrix metal to solidify;

passing coolant through said at least one passage during solidification of said matrix metal, such that a more rapid freezing of said matrix is obtained in a region close to said at least one passage than in more remote parts of said powder body, whereby sucking in of matrix metal from a surface region into said more remote parts of said powder body as a result of shrinkage of said matrix due to continued solidification is counteracted.

2. A method as claimed in claim 1, wherein said at least one passage comprises one or more tubes having an external surface and being formed of a metal having a melting point which is higher than said sintering temperature of said sinterable material, said one or more tubes being located in said mould on an inner side of said surface of said article to be formed with a fine and controlled structure, said one or more tubes being embedded in said sinterable material when said mould is filled with said powder or grains of said sinterable material, said matrix metal flowing round said one or more tubes embedded in said powder body and forming a metallic bond between said matrix metal and said one or more tubes when said matrix metal is melted and caused to filtrate into to said powder body.

3. A method as claimed in claim 2, wherein said metal of said one or more tubes is dissolvable in said matrix metal in its molten state, said metal in said external surface of said one or more tubes being removed to a slight depth and dissolved in said matrix metal before said matrix metal solidifies.

4. A method according to claim 2 wherein said sinterable material comprises hardenable steel powder containing carbon, and wherein said tube consists of steel tube.

5. A method as claimed in claim 4 wherein said tube consists of stainless steel.

6. A method as claimed in claim 1, wherein said matrix metal comprises a metal selected from a group consisting of copper, tin, nickel, zinc, aluminum, niobium and beryllium.

7. A method as claimed in claim 1, wherein said matrix metal comprises copper together with tin and/or another metal which reduces the capacity of said copper to dissolve iron in the molten phase.

8. A method as claimed in claim 2, wherein said powder body is sintered and said matrix metal is melted and caused to infiltrate into said powder body in a heated furnace at a temperature of between 1,000° C. and 1,200° C., said coolant being conveyed through said one or more tubes via connections extending out of said furnace, said matrix metal adjacent said tube being frozen initially, and remaining matrix being caused to solidify when the temperature in said furnace has dropped below 800° C. and at least when freezing of said matrix close to said one or more tubes has stabilized.

9. A method as claimed in claim 8, wherein said powder body is sintered under vacuum or in an atmosphere of inert gas, said coolant is air, and said temperature is dropped below 700° C. before remaining matrix is caused to solidify, said mould and its contents being forced cooled to solidify said matrix.

10. A method as claimed in claim 1, wherein said at least one cooling passage is located within said mould close to a moulding surface which is to give said article a fine and controlled structure, said at least one cooling passage substantially following the shape of said moulding surface to cover said surface or selected parts thereof, such that during solidification of said matrix metal, passage of coolant through said at least one cooling passage causes a more rapid freezing of said matrix in a region near said at least one cooling passage than in other parts of said powder body.

11. A method as claimed in claim 10, wherein said mould is formed from a ceramic composition, and said at least one cooling passage comprises one or more tubes which are embedded in said ceramic composition.

12. A method as claimed in claim 11, wherein said one or more tubes in said ceramic mould has a low or substantially the same coefficient of expansion as the ceramic composition.

13. A method as claimed in claim 12, wherein said one or more tubes comprises steel containing about 40% nickel and 60% iron.

14. A method as claimed in claim 10, wherein said mould is formed from a ceramic composition, and said passage comprises cavities formed in said ceramic mould in known manner using meltable cavity formers of wax or the like.

15. A method as claimed in claim 10, wherein said mould is formed from a ceramic composition, and said passage comprises one or more tubes formed from said ceramic composition or from a ceramic material having at least substantially the same coefficient of expansion as the ceramic composition from which the mould is made.

16. A method as claimed in claim 1, wherein said passage has a spiral winding or bending configuration to cover an entire surface or selected portions thereof and provide cooling therefor.

17. A method as claimed in claim 1, wherein said passage has a pronounced breadth extension in a direction parallel to a portion of a surface region to be cooled and cover said portion or selected parts thereof to thereby provide cooling to the said portion or said selected parts thereof.

18. A method as claimed in claim 1, wherein one or more passages are provided in said powder body and in said material of said mould.

19. An article produced in a mould, said mould comprising a moulding surface defining contours of said article, said article comprising:

a body formed from a composition comprising a sinterable material having a sintering temperature which, before sintering, is shapable into a desired shape and which, during sintering, forms a porous body having pores, said sinterable material being at least partially sintered in said mould, and a matrix having a lower melting point than said sintering temperature of said sinterable material, said matrix comprising a matrix metal which is infiltrated in said porous body to substantially fill said pores;

at least one metal tube having an outside surface and being disposed in said body to provide one or more cooling passages in said body, said at least one metal tube comprising a metal having a melting point which is higher than said sintering temperature of said sinterable material, a portion of said outside surface of said at least one metal tube being partially removed by being dissolved in said matrix metal prior to solidification of said matrix metal to bond said matrix and said at least one tube together, said sinterable material being dissolvable in said matrix metal in its molten state, thereby limiting dissolution of said metal of said metal tube in said matrix so that removal of said metal from said outside surface of said at least one metal tube is insignificant to affect operation of said at least one metal tube.

20. An article as claimed in claim 19, wherein said sinterable material and said metal of said at least one tube consist essentially of the same metal.

21. An article as claimed in claim 20, wherein said metal is iron.

22. An article as claimed in claim 20, wherein said sinterable material comprises hardenable steel powder containing carbon, and said at least one metal tube consists of steel tube.

23. An article as claimed in claim 22, wherein said tube is of stainless steel.

24. An article as claimed in claim 20, wherein said matrix comprises a metal selected from the group consisting of copper, tin, nickel, zinc, niobium, aluminum, and beryllium.

25. An article as claimed in claim 21, wherein said matrix comprises copper together with a certain amount of tin and/or another metal which reduces the capacity of said copper to dissolve iron.

26. An article as claimed in claim 19, wherein said at least one metal tube is located at a short distance from a mould surface, said tube having a spiral winding or bending configuration to cover substantially all of said mould surface or selected portions thereof, such that all of said mould surface or such selected portions thereof are cooled when coolant is passed through said tube.

* * * * *